United States Patent [19]

Luce

[11] 3,981,218

[45] Sept. 21, 1976

[54] PRESET SYSTEM FOR ELECTRONIC MUSICAL INSTRUMENT

[75] Inventor: David A. Luce, Clarence Center, N.Y.

[73] Assignee: Norlin Music, Inc., Lincolnwood, Ill.

[22] Filed: June 14, 1974

[21] Appl. No.: 479,443

[52] U.S. Cl. ..... 84/1.24; 84/1.26

[51] Int. Cl.[2] ..... G10H 1/02

[58] Field of Search ..... 84/1.01, 1.03, 1.25, 84/1.26, 1.19, 1.24

[56] References Cited

UNITED STATES PATENTS

| | | | |
|---|---|---|---|
| 3,518,352 | 6/1970 | Plunkett | 84/1.03 |
| 3,546,355 | 12/1970 | Maynard | 84/1.03 |
| 3,617,602 | 11/1971 | Kniepkamp | 84/1.24 |
| 3,688,010 | 8/1972 | Freeman | 84/1.25 X |
| 3,749,837 | 7/1973 | Doughty | 84/1.01 X |
| 3,842,184 | 10/1974 | Kniepkamp et al. | 84/1.03 X |

*Primary Examiner*—Ulysses Weldon

*Attorney, Agent, or Firm*—Hill, Gross, Simpson, Van Santen, Steadman, Chiara & Simpson

[57] ABSTRACT

A separate group of function preset controls is provided for each of a plurality of individually adjustable functions, to select predetermined values for such functions or, alternatively, to allow manual adjustment thereof. A supervisory preset control is provided for controlling the operation of several different function preset controls, in accordance with an overall plan including predetermined settings for a plurality of functions. In one mode of operation of the supervisory preset control, each of the function preset controls is placed in its manually adjustable mode, so that the individual functions are all controlled by manual adjustment. In other modes of operation, each of the function preset controls is placed in one of its fixed modes, to establish a predetermined fixed combination of function settings.

11 Claims, 12 Drawing Figures

Fig. 1
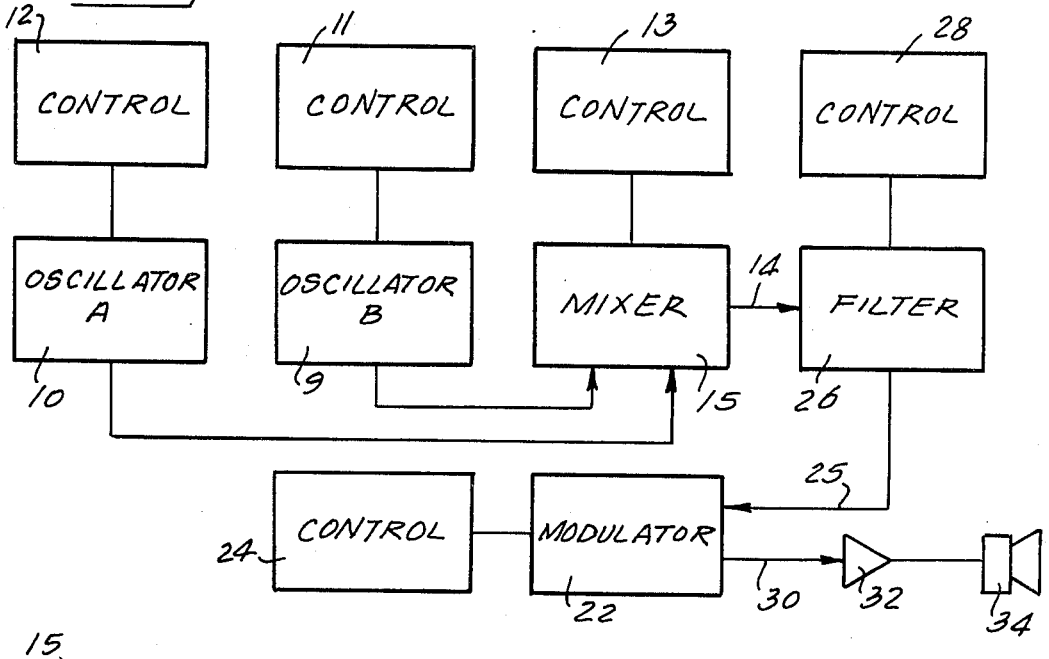
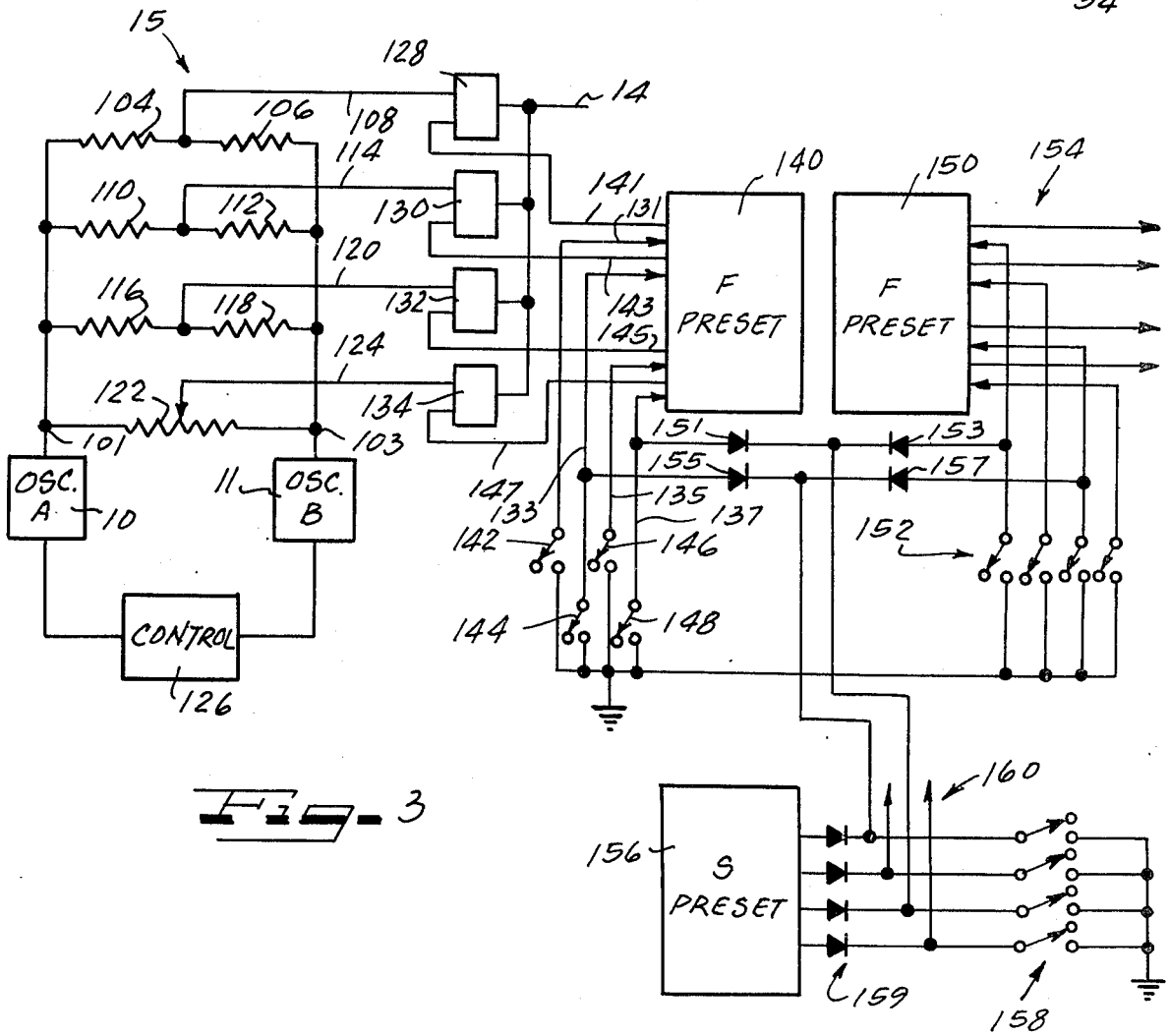
Fig. 3

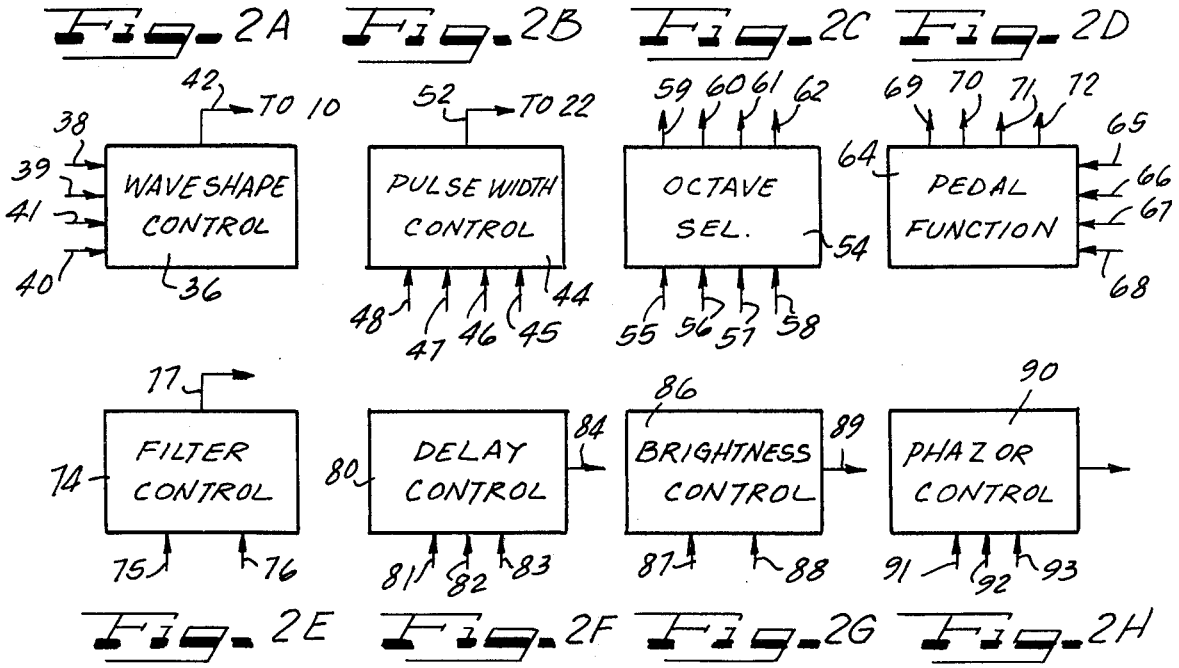
Fig. 2A
Fig. 2B
Fig. 2C
Fig. 2D
WAVESHAPE CONTROL
PULSE WIDTH CONTROL
OCTAVE SEL.
PEDAL FUNCTION
FILTER CONTROL
DELAY CONTROL
BRIGHTNESS CONTROL
PHAZOR CONTROL
Fig. 2E
Fig. 2F
Fig. 2G
Fig. 2H
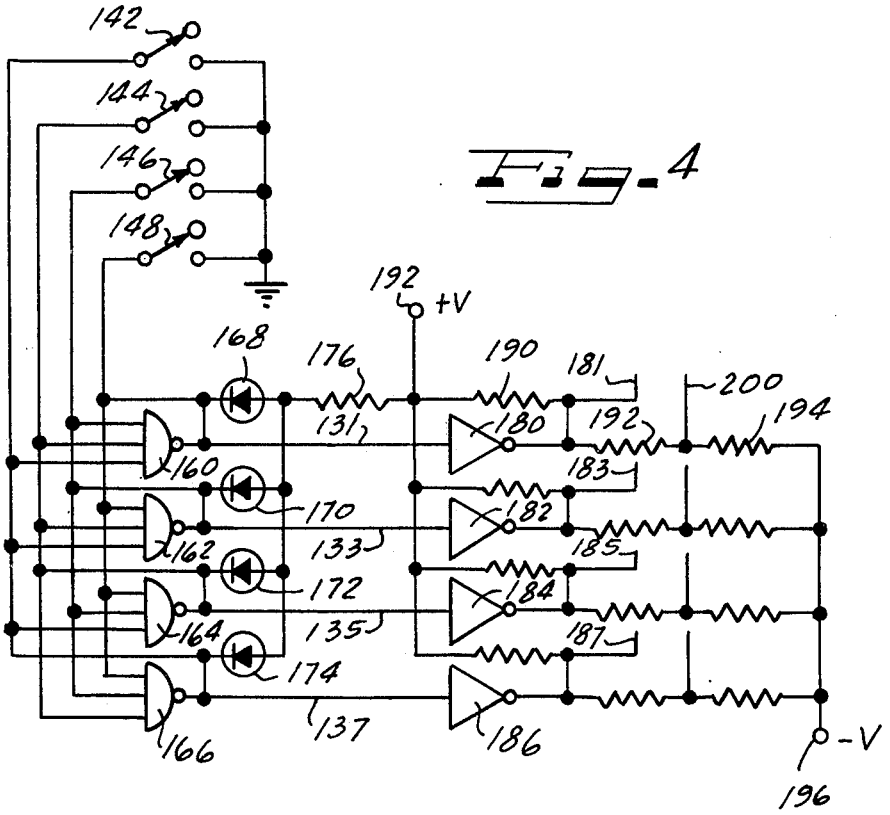
Fig. 4
+V
-V

PRESET SYSTEM FOR ELECTRONIC MUSICAL INSTRUMENT

BACKGROUND

1. Field of the Invention

The present invention relates to electronic musical instruments, and more particularly to electronic synthesizer instruments in which one or more oscillators is controlled to produce musical sounds of controllable frequency, and incorporating a variety of manual controls provided for modulators, filters, and the like, by which the quality of the sound produced by the instrument may be varied under the control of the operator or player.

2. The Prior Art

Synthesizers in the past have included a variety of programmable or adjustable functions, the variation of which results in changes in the quality of sound produced by the instrument. A difficulty is presented during the playing of such an instrument, however, when the player wishes rapidly to change from one sound quality to another, different sound quality. In the past, the only way that such a shift could be made, if it involved changing more than a very few function parameters, was by the operator adjusting a series of manual controls until the parameters were changed as desired. This is in many cases a relatively time consuming task and requires the attention of the player to each of the function controls, successively, so that it is not ordinarily possible for the player to continue to play the instrument while he is changing the configuration of the controls. Thus, the instrument can be configured to produce radically different sounds, involving the adjustment of several function controls, only at the beginning of a musical composition. Drastic and sudden changes in sound during the playing of a musical composition are not ordinarily possible, because of the need to manipulate the controls one-by-one.

It is therefore desirable to provide a method and apparatus by which these disadvantages might be overcome.

SUMMARY OF THE PRESENT INVENTION

It is one object of the present invention to provide a system of function presets for an electronic musical instrument whereby any of a plurality of preselected functional configurations for the instrument can be selected by operation of a single switch, rather than by the manual adjustment of a plurality of manual controls.

It is another object of the present invention to provide such a system in which a number of function preset controls are provided for selecting function parameters for the operation of various portions of the instrument, and a supervisory preset control for selecting predetermined combinations of parameters for individual function preset controls.

A further object of the present invention is to provide such a system in which the functional parameters selected by operation of the preset may be modified individually by manual control of the operator or player.

These and other objects and advantages of the present invention will become manifest upon a review of the following description and the accompanying drawings.

In one embodiment of the present invention there is provided an electronic musical instrument having a plurality of functional units which cooperate to produce musical sound waves, a control device for each functional unit, such control device having a manually operable control by which the operation of the control device is regulated, a function preset device connected with each control device for selecting a predetermined parameter for its functional unit, and a supervisory preset device connected to a plurality of function preset devices for simultaneously selecting a predetermined combination of parameters for the functional units.

BRIEF DESCRIPTION OF THE DRAWINGS

Reference will now be made to the accompanying drawings, in which:

FIG. 1 is a functional block diagram of a synthesizer instrument incorporating an illustrative embodiment of the present invention;

Figure 5:
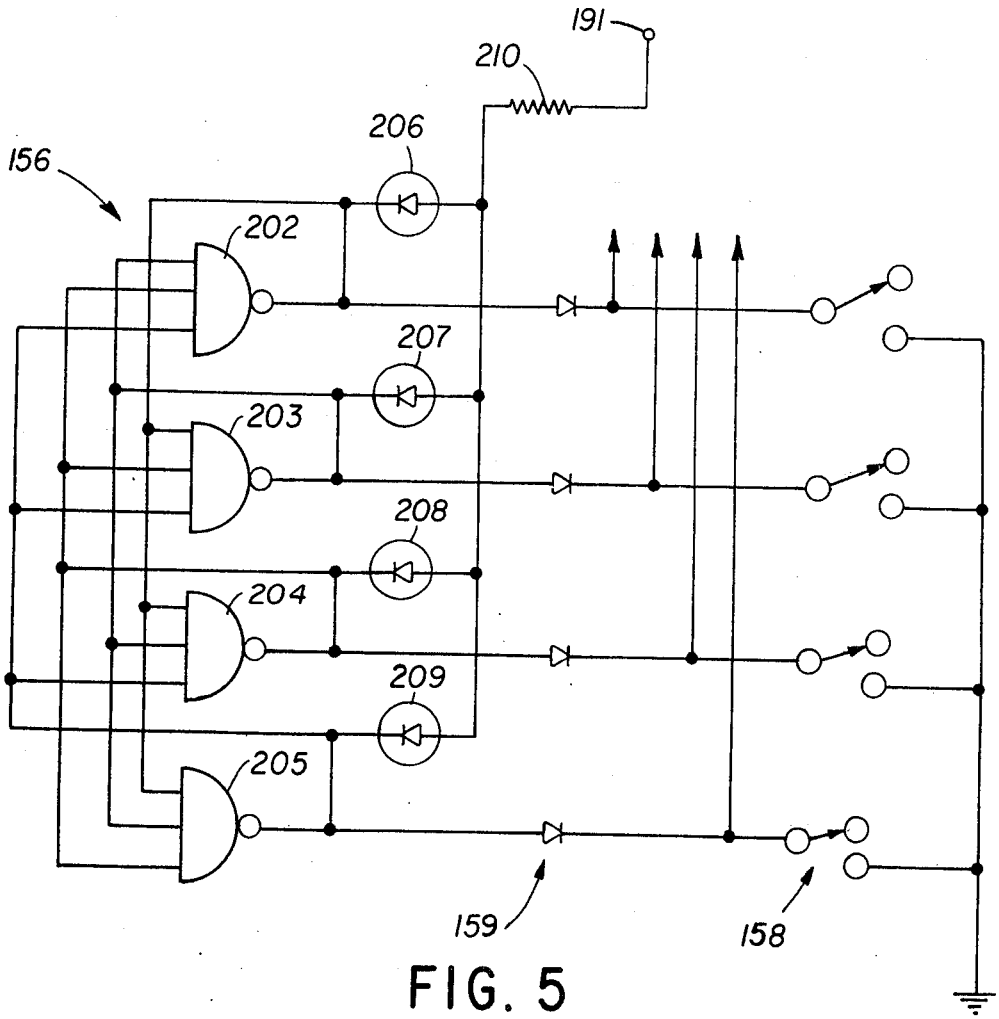

FIGS. *2a* –*2h* make up functional block diagrams of certain portions of the system shown in FIG. 1, such portions being illustrated in greater detail;

FIG. 3 is a schematic circuit diagram, partly in functional block diagram form, showing details of a function preset device;

FIG. 4 is a functional block diagram, partly in schematic circuit diagram form, of a functional preset device; and FIG. 5 is a functional block diagram, partly in schematic circuit diagram form, of a supervisory preset device.

DESCRIPTION OF THE PREFERRED EMBODIMENTS

Referring now to FIG. 1, there is shown a functional block diagram, in simplified form, of an electronic synthesizer instrument incorporating an illustrative embodiment of the present invention. An oscillator 10 is provided which is controlled in its operation by a control device 12. A second oscillator 9 is controlled by a control device 11. Outputs of the two oscillators 9 and 10 are connected to two inputs of a mixer 15, which is controlled by a control device 13. The output of the mixer 15 is produced on a line 14 which is connected to a filter 26, which is controlled by a control device 28. The filter filters the signal on the line 14 and passes it to a line 25. The line 25 functions as the input line to a modulator unit 22, which is under control of a control device 24. The modulator 22 effects additional changes in the character of the signal on the line 25 and passes it to an output line 30. The output line 30 is connected through an amplifier 32 to a loudspeaker 34, which converts the electrical signals on the line 30 into audible sound waves.

It can be seen from FIG. 1 that each functional unit in the system is under the control of a control device. Each of the control devices may be adjusted or controlled by an operator or player in order to produce the desired characteristics for the sound produced by the loudspeaker 34. Generally speaking, each of the control devices controls a different parameter, so that the effect of adjusting each of the control devices is to produce a unique change in sound character. The illustration in FIG. 1 is simplified, and in actuality there are a great number of control devices more than the five control devices shown in FIG. 1. Accordingly, it is extremely difficult for an operator to make multiple adjustments of the control devices while he is playing, especially if it is desired to make some of the adjustments simultaneously.

FIGS. 2*a*–2*h* show, in greater detail, some of the control devices which may be associated with the present invention and the input terminals of the control devices which must be energized in order to bring about a given control function. FIG. 2*a* shows a wave shape control device 36, which has four input terminals connected with four input lines 38, 39, 40, and 41. The wave shape control device 36 may form a part of control device 12, and is then connected with the oscillator 10, via one or more lines 42, to control the wave shape produced at the input of the mixer 15. One of the four input terminals is energized at any given time. When the line 38 is energized, the control 36 causes the oscillator to produce a square wave. When the control line 39 is energized, the oscillator produces a sine wave. When the line 40 is energized, the oscillator produces a single pulse output, corresponding in time with the energization of a control line (not shown), as when a key of a keyboard is operated, for example. When the line 41 is energized, the oscillator 10 is turned off, and does not produce any output.

A pulse width control device 44 is shown in FIG. 2*b*. It is provided with four input lines 45, 46, 47, and 48. The control device 44 may be included as part of the control device 24, and is then connected with the modulator 22. The operation of the pulse width control is to vary the width of a pulse appearing at the input of the modulator 22 and to produce a modified pulse at the output of the modulator. The relative width of the output pulse is dependent upon which of the four control lines 45–48 is energized at any given time. When the line 45 is energized, a thin output pulse is produced, so that if a square wave is applied to the modulator 22, a train of output pulses is produced in which each of the pulses is relatively narrow and the pulses are separated by a relatively wide space.

When the control line 46 is energized, and a square wave is applied to the input of the modulator 22, the output pulse width has a preselected duty cycle which gives the closest representation to a piano tone. This is typically about a fifteen percent duty cycle. When the input line 46 is selected and a square wave is provided to the modulator input, the output pulses have a fifty percent duty cycle, so that they constitute an unmodified square wave output signal. When the line 48 is energized, the duty cycle of pulses on the line 52 is made variable, under the control of a manually adjustable control (not shown). In this way, the operator or player can select any desired duty cycle or pulse width.

FIG. 2*c* shows an octave select unit 54, which may also be a part of the control device 12. It has four input lines 55, 56, 57, and 58. Four controlling output lines 59, 60, 61, and 62 are provided which are connected to individual gates for controlling the operation of the oscillator 10 within a particular range of frequencies. In this way, the particular octave in which the sounds are produced by the loudspeaker is selected. The control line 56 is arbitrarily designated as the normal control line and, when it is energized, the normal range of frequencies is produced by the oscillator 10. If the control line 55 is energized, the pitches are one octave lower than when the line 56 is energized, and when the control line 57 is energized, the range of pitches is one octave higher. The pitch range is two octaves higher when the control line 58 is selected.

A pedal function control device 64 is provided, which may be a part of the modulator control device 24. It has four control lines 65, 66, 67, and 68. Three output lines 69, 70, and 71 are provided, which are energized individually in response to energization of one of the four input lines 65–68. The three output lines 69–71 are connected individually with three gates in the system and establish a path between a foot pedal and three different destinations within the system.

When the input line 65 is energized, none of the output lines 69–71 is energized. When the line 66 is energized, the output line 69 functions to close a gate (not shown) establishing a connection from the pedal function control device to the control input of the device which controls the rate of decay of a pulse. By this means, operation of the foot pedal by the player's foot controls the sustain of sounds produced in response to operation of various keys of the keyboard.

When the control line 67 is energized, the line 70 is energized, and the pedal is connected by a gate (not shown) to a controlling input of a filter unit, so that operation of the foot pedal controls the cutoff frequency or passband of the filter. When the line 68 is energized, the line 71 is energized, and a connection is established by which the foot pedal is connected through a gate (not shown) to a control device which controls the shape of pulses produced in response to operation of the keyboard keys. The pedal function control device 64 is, therefore, operative to physically connect the foot pedal to three different functional units, so that the effect of operation of the foot pedal is dramatically changed.

FIG. 2*e* shows a filter control unit 74 having two control inputs 75 and 76. An output line 77 is connected to a voltage controlled filter 26, and the voltage level on the line 77 determines the operating parameters of the filter, including the cutoff frequency. If the input line 75 is energized, one voltage level is produced on the output line 77, while if the input line 76 is energized, the voltage level on the line 77 is variable, as selected by the operator through positioning of the tap of a potentiometer (not shown). The operation of the filter when the line 75 is energized is that required for the filter to produce a piano tone, so that a piano can be simulated readily when the line 75 is energized. The filter operation when the input line 76 is energized is variable, under control of the operator.

A decay control device 80 is shown in FIG. 2*f*, which device may form part of the control device 24. Three input lines 81, 82, and 83 control the level on an ouput line 84. Various voltage levels on the line 84 are responsible for determining various decay characteristics of the envelope produced by the modulator 22 in response to depression of the keys of the keyboard. When the input line 81 is energized, the decay characteristic corresponds with that of an acoustic piano. When the line 82 is energized, the decay time is essentially infinite, meaning that the tone is sounded continuously until the operator actuates another key of the keyboard. When the line 83 is energized, the decay is made variable under control of the operator through the use of a potentiometer (not shown).

A brightness control device 86 is shown in FIG. 2*g*. It has two input lines 87 and 88 and an output line 89, and forms a portion of the control device 28 for controlling operation of the filter 26. The voltage level on the line 89 is determined by which of the two input lines 87 and 88 is energized. When the line 87 is energized, the voltage level on the line 89 causes the filter to operate to produce a brightness of the output signal corresponding to an acoustic piano, while when the input line 88 is energized, the brightness is made variable under control of the operator through the use of a potentiometer (not shown).

A phazor control device 90 is shown in FIG. 2*h*. It also may form a part of the control device 24, and has three input lines 91, 92, and 93 and an output line 94. The voltage level on the line 94 depends upon which of the three input lines is energized. When the line 91 is energized, the phazor operation is normal, and the modulator 22 is caused to modify the pulse width of the pulse on the line 14, in response to the amplitude of an evelope signal generated by part of the control 24. For low amplitude levels of the envelope signal, the pulse shape is narrow, and the wave shape changes to become wider as the amplitude increases. When the line 92 is energized, the operation is the inverse of normal operation, so that the wave shape grows narrower as the amplitude increases. When the line 93 is energized, the phazor control 90 is disabled, so that there is no variation in pulse width with changes in the amplitude of the envelope signal.

Referring now to FIG. 3, there is a schematic circuit diagram of a function preset used in association with the control device 13 of FIG. 1, to determine the proportion of the outputs of two oscillators which are to be mixed to form a composite signal to be furnished to the line 14. The two oscillators 10 and 11 produce outputs on lines 101 and 103, respectively, which are connected to opposite terminals of the mixer unit 15. The mixer 15 incorporates a network of resistors. Resistors 104 and 106 are connected in series between the lines 101 and 103, and the junction of these two resistors is connected to an output line 108. Resistors 110 and 112 are also connected in series between the lines 101 and 103, and the junction of these resistors is connected to a second output line 114.

Resistors 116 and 118 are connected in series between lines 101 and 103, and the junction of these resistors is connected to a third output line 120. The two end terminals of a potentiometer 122 are also connected between the lines 101 and 103, and the tap of the potentiometer 122 is connected with a fourth output line 124. The two oscillators 10 and 9 are controlled in their operation by a control device 126, which incorporates the control devices 11 and 12 of FIG. 1, and the details of which form no part of the present invention.

The four output lines 108, 114, 120, and 124 are connected to one input (viz., the signal input) of each of four analog gates 128, 130, 132, and 134, the outputs of which are connected in common to an output line 14. The other input (viz., the control input) of each of the four gates 128, 130, 132, and 134 is connected to each of four output lines 141, 143, 145, and 147 of a function preset unit 140. The function preset unit 140 has four switches 142, 144, 146, and 148, each of which functions to connect one of the four input lines 131, 133, 135, and 137 to ground. The switches 142, 144, 146, and 148 are preferably momentary acting push button switches, which are electrically or mechanically interlocked in such a way that only one switch at a time may be closed. The function preset unit 140 produces a high level signal on one of its four output lines 141, 143, 145, and 147 in response to energization of its corresponding switch, and the other output lines exhibit a low potential, so that only one output line of the selector unit 140 is energized at any given time, viz., that corresponding to the most recently operated switch. Thus, one of the four analog gates is enabled, and the output of the mixer unit on the line 14 is provided with different proportions of outputs from the oscillators 9 and 10 in response to operation of different ones of the switches 142, 144, 146, and 148.

A second function preset unit 150 is shown in FIG. 3, representing any of these illustrated in FIGS. 2*a*–2*h*. It also has four manually controllable switches 152, operable in one-at-a-time fashion, by which one of its four output lines 154 may be made high for activation of one of four analog gates (not shown) to perform a control function somewhere in the system.

Each of the push button switches 142, 144, 146, 148, and 152 may be operated individually, so that individual functions can be selected for execution by the function preset device 140 and the function preset device 150. A supervisory preset unit 156 is provided, and the switches 158 of the supervisory preset unit simultaneously set the supervisory preset unit 156 into one of its stable states and cause the function preset units 140 and 150 to select a given configuration of outputs, corresponding to a preselected configuration.

The switches 158 are also connected by diodes 151, 153, 155, and 157 to individual selected output lines of the function preset units 140 and 150, and function to operate the function preset units 140 and 150 in the same manner as if one of their controlling switches had been operated. In this manner, operation of one of the switches 158 has the effect of setting the states of the supervisory preset unit 156 and both of the function preset units 140 and 150. The other switches 158 are connected to the outputs of the function preset units in other combinations, so that operation of each individual switch 158 causes the entire system to be set up in a preselected way, with preselected operations of all of the function preset units. Diodes 159, interconnected between the outputs of the supervisory preset unit 156 and the switches 158, function to decouple the function preset units from the supervisory preset unit so that the settings of the function preset units may be changed after the switches 158 resume their normal open condition.

Referring now to FIG. 4, a schematic diagram, partly in functional block diagram form, is illustrated showing details of the function preset unit 140. The unit includes four NAND gates 160, 162, 164, and 166, which are cross coupled so that only one produces an output at a low potential and the other three produce an output at approximately the potential of the supply voltage. Each of the four NAND gates 160–166 has three inputs, which are each connected to the outputs of the other three gate, respectively. Thus, the three inputs of the gates 160 are connected to the outputs of the gates 162, 164, and 166, and the other gates have their inputs correspondingly connected. Thus, when the gates 162–166 all have high outputs, the gate 160 has a low output. Since the gates 162–166 all have the low output of the gate 160 connected as an input, the gates 162–166 are all inhibited and maintain their outputs high. One of the switches 142–148 is connected between the output of the four gates 160–166 and ground, individually, so that closing one of the switches 142–148 drops the potential at the output of one of the gates to ground, and thereby triggers that gate into its actuated condition, disabling the other three.

A series of four LED's 168, 170, 172, and 174 are connected individually to the outputs of the four gates 160–166, with the free end of each of the LED's 168–174 connected through a resistor 176 to a source of positive potential at a terminal 178. As only one of the NAND gates has an output at ground level, the LED for only that gate is actuated. The diodes 159 are connected directly to the outputs of the gates 160–166. The function preset units incorporate more structure, which will now be described.

An inverter 180 is connected to the output of the gate 160, to furnish on an output line 181 a potential which is high when the gate 160 is actuated. Similarly, the other three gates 162–166 are provided with inverters 182, 184, and 186, respectively, which invert the outputs of the NAND gates to which they are connected and supply an inverted potential to three additional output lines 183, 185, and 187.

The line 181 is connected by a resistor 190 to a source of positive potential at a terminal 191 and functions as a pull-up resistor. Two resistors 192 and 194 are connected from the line 181 to a source of negative potential connected to a terminal 196. The junction of the resistors 190 and 192 is connected by the line 181 to the control input of a gate reqiring a relatively high operating control voltage level. The line 181 is normally at ground potential, but assumes a potential near that of the supply voltage connected to terminal 192 when the gate 180 is operated.

The junction of the resistors 192 and 194 is connected to a second output line 200. The resistors 192 and 194 function as a voltage divider, so that the line is near ground potential when the gate 180 is operated and at other times assumes a negative potential of approximately half the value of that applied to the terminal 196. In one embodiment the resistor 190 is 4.7 K ohms and the resistors 192 and 194 are both 100 K ohms. The line 200 is connected to inputs of control devices such as gates and the like which require different control voltage levels than the gates connected to the line 181.

Referring now to FIG. 5, a schematic diagram, partly in functional block diagram form, is illustrated showing details of the supervisory preset unit 156. The unit includes four NAND gates 202–205, which are cross coupled so that only one produces an output at a low potential, with the other three producing a high potential, just as in the circuit of FIG. 4. Four LED's 206–209 are connected to the outputs of the NAND gates 202–205, and their anodes are connected in common through a resistor 210 to a source of supply voltage at a terminal 191. The LED for the one NAND gate which is actuated (with a low potential at its output) is illuminated, to indicate the state of the supervisory preset. The outputs of the gates 202–205 are connected through the diodes 159 to the other circuitry illustrated in FIG. 3, and the supervisory preset is placed in one of its states by a momentary operation of one of the switches 158, as described above in connection with FIG. 3.

The system provides a plurality of function preset controls operable to select predetermined operational parameters for control devices of a synthesizer instrument. The individual function preset controls are available for each functional unit, and the supervisory preset control is provided for simultaneously enabling selected inputs of a number of the function preset controls to place the instrument into a given condition in response to actuation of each individual switch of the supervisory preset controls.

The resistors 190, 192, and 194 described above for the gate 180 have counterparts which are connected with the outputs of the other gates 182, 184, and 186, and function in the same manner as described above. They are energized when their respective gates are energized.

The diodes 159, which are connected between the supervisory preset unit 156 and the switches 158, and the diodes 151, 153, 155, and 157 operate to decouple individual function presets which are selected by operation of the supervisory preset unit. The diodes 151, 153, 155, and 157 permit only relatively short pulses to be supplied to control operation of the function preset units, while the push button switches 158 are closed. Thus, while the individual function preset units are set into a predetermined condition by operation of one of the control switches of the supervisory preset, the function presets are nevertheless capable of being controlled by means of the individual function switches provided therefor. Adjustments in the function preset units may be made individually without affecting the setting of other function preset controls as determined by operation of the supervisory preset control. Thus, when the operator wishes to change the configuration of the instrument which is almost, but not quite, like the configuration set up by operation of one of the supervisory preset switches, he can quickly do so by first operating a supervisory preset switch and immediately afterwards operating the preset switch for the function preset which is to be changed.

Although the present invention is not limited to any particular instrument configuration established by the preset controls, it is preferable to establish one supervisory preset condition which arranges the various components of the instrument to simulate an acoustic piano by controlling the parameters of the various function units accordingly. One other supervisory preset condition simulates a pipe organ or an electronic organ, and yet another renders all of the manually operable variable controls effective, so that any desired configuration is set up by operating the supervisory preset switch which sets up that condition.

In each case, the LED's 168–174 indicate to the operator the current configuration of the instrument, to facilitate the rapid setting up of any desired configuration.

The NAND gates such as the unit 160 are preferably 7400 series integrated circuit devices, such as model number 7410. The inverters such as 180 are preferably units such as model number 7426. The analog gates employed in the system for establishing connections in response to outputs of the function preset units are preferably units such as model number 4016AE, integrated circuits, which are commercially availabe from RCA.

The structure illustrated in schematic form in FIG. 3 for the control unit 13 is typical of the control units illustrated in block diagram form in FIGS. 2*a*–2*h*. The specific details of such control units form no part of the present invention and are, therefore, not described herein. Control circuitry which performs the functions of the control units of FIGS. 2*b* and 2*e*–2*h* is illustrated in the co-pending application Ser. No. 479,485, entitled "Electronic Musical Instrument with Dynamically Responsive Keyboard," filed contemporaneously herewith; the unit of FIG. 2*c* is illustrated in the co-pending application Ser. No. 479,444, entitled "Electronic Musical Instrument With Exponential Keyboard with Voltage Controlled Oscillator," also filed contemporaneously herewith.

It will be apparent to those skilled in the art that various modifications may be made to the subject matter of the present invention, without departing from the essential features of novelty thereof, which are intended to be defined and secured by the appended claims.

What is claimed is:

1. In an electronic musical instrument having a signal source, an output system for producing sound waves corresponding to a signal derived from said source, and a plurality of modifying means interposed between said signal source and said output system, the combination comprising a plurality of independently settable function preset units, one for each of said modifying means, each for controlling an operating parameter of said modifying means, a supervisory preset unit having a plurality of noncontinuous discrete operating modes, and connecting means connecting said supervisory preset unit with a plurality of said function preset units for causing said function preset units, irrespective of their prior condition, to control said operating parameters in different predetermined configurations for each operating mode of said supervisory preset unit, one or more of said operating parameters being changed in each configuration.

2. Apparatus according to claim 1, wherein one of said modifying means is a voltage controlled device having an operating parameter controllable in response to the level of a control voltage, the function preset unit connected with said modifying means being operable to control the level of said control voltage.

3. Apparatus according to claim 2, wherein said function perset unit comprises a device having a plurality of mutually exclusive stable states, and control means connecting said function preset unit to said modifying means for selecting a different value for said operating parameter for each of said states of said function preset unit.

4. Apparatus according to claim 3, wherein each said function preset unit comprises a plurality of cross coupled digital gates, each of said digital gates having inputs connected with the outputs of all of the other digital gates of said function preset unit.

5. Apparatus according to claim 3, wherein said function preset unit has a plurality of outputs and said mutually exclusive stable states are each manifested by a unique voltage level present on one of said outputs, and including a plurality of indicating devices connected between individual ones of said outputs and a source of a reference voltage, whereby one of said indicating devices is operated when said function preset is in a corresponding one of its stable states.

6. Apparatus according to claim 3, including a plurality of push button switches connected with said function preset unit, each of said switches being operative to place said function preset unit into a selected one of its stable states.

7. Apparatus according to claim 6, wherein said function preset unit has a plurality of outputs and said mutually exclusive stable states are each manifested by a unique voltage level present on one of said outputs, and including means for connecting each of said switches between an individual one of said outputs and said reference voltage.

8. Apparatus according to claim 1, wherein said supervisory preset unit comprises a device having a plurality of mutually exclusive stable states.

9. Apparatus according to claim 8, wherein said supervisory preset unit comprises a plurality of cross coupled digital gates, each of said digital gates having inputs connected with the outputs of all of the other digital gates.

10. Apparatus according to claim 8, including a plurality of switches connected with said supervisory preset unit and each operative to place said supervisory preset unit into a selected one of its stable states.

11. Apparatus according to claim 8, wherein said supervisory preset unit has a plurality of outputs and said function preset units have a plurality of mutually exclusive stable states for controlling an operating parameter in response to the state of said function preset unit, and wherein said connecting means comprises momentary acting means connected to said outputs for placing selected function preset units into predetermined states in response to a change of state of said supervisory preset unit.

* * * * *